US006875045B1

(12) United States Patent
Hollick

(10) Patent No.: US 6,875,045 B1
(45) Date of Patent: Apr. 5, 2005

(54) ELECTRICAL CONNECTOR WITH DEFORMABLE INSERT

(75) Inventor: David John Hollick, Chinnor (GB)

(73) Assignee: B&H (Nottingham) Limited, (GB)

( * ) Notice: Subject to any disclaimer, the term of this patent is extended or adjusted under 35 U.S.C. 154(b) by 0 days.

(21) Appl. No.: 09/936,492

(22) PCT Filed: Mar. 2, 2000

(86) PCT No.: PCT/GB00/00747

§371 (c)(1),
(2), (4) Date: Sep. 11, 2001

(87) PCT Pub. No.: WO00/54371

PCT Pub. Date: Sep. 14, 2000

(30) Foreign Application Priority Data

Mar. 11, 1999 (GB) ..... 9905505

(51) Int. Cl.[7] ..... H01R 11/20
(52) U.S. Cl. ..... 439/411; 439/783; 439/797
(58) Field of Search ..... 439/411, 412, 800, 439/793, 791, 810, 877, 879, 811–814, 783, 439/797–798, 781–782

(56) References Cited

U.S. PATENT DOCUMENTS

| | | | | |
|---|---|---|---|---|
| 796,797 | A * | 8/1905 | Blackburn | 439/800 |
| 2,396,119 | A * | 3/1946 | O'Neil | 219/136 |
| 2,440,748 | A * | 5/1948 | Johnson | 174/158 R |
| 3,016,510 | A * | 1/1962 | Blonder | 439/411 |
| 3,125,397 | A * | 3/1964 | McGrath | 439/811 |
| 3,674,916 | A * | 7/1972 | Langella | 174/169 |
| 3,848,956 | A * | 11/1974 | Kraft | 439/411 |
| 4,050,761 | A * | 9/1977 | De France | 439/411 |
| 4,120,554 | A * | 10/1978 | Bianchi et al. | 439/411 |
| 4,547,033 | A * | 10/1985 | White et al. | 439/391 |
| 4,620,755 | A * | 11/1986 | Yonkers et al. | 174/78 |
| 4,687,273 | A * | 8/1987 | Pranch | 439/411 |
| 4,953,289 | A * | 9/1990 | Schreck et al. | 174/94 R |
| 5,167,526 | A * | 12/1992 | Pinyan et al. | 439/411 |
| 5,320,565 | A * | 6/1994 | Polidori | 439/791 |
| 5,422,438 | A * | 6/1995 | Lamome | 174/84 C |
| 5,494,462 | A * | 2/1996 | Auclair | 411/300 |
| 5,616,036 | A * | 4/1997 | Polidori | 248/74.1 |
| 5,630,737 | A * | 5/1997 | Dupont | 439/797 |
| 5,816,844 | A * | 10/1998 | Perera | 411/82 |

(Continued)

FOREIGN PATENT DOCUMENTS

FR 2661045 A1 * 1/1990

(Continued)

OTHER PUBLICATIONS

Copy of International Search Report of PCT/GB00/00747.

(Continued)

*Primary Examiner*—Gary Paumen
*Assistant Examiner*—Edwin A. Leon
(74) *Attorney, Agent, or Firm*—Myers Bigel Sibley & Sajovec

(57) ABSTRACT

Electrical connectors are provided including a connector body with a tubular socket to receive an electrical conductor. A clamping means is arranged to secure the electrical conductor within the socket. A socket insert fits within the socket so as to reduce the effective size of the socket. The socket insert is tubular and is adapted to be deformed by the clamping means into retaining engagement with the electrical conductor.

28 Claims, 2 Drawing Sheets

U.S. PATENT DOCUMENTS 6,109,984 A * 8/2000 Tsou ..... 439/888
6,165,004 A * 12/2000 Robinson ..... 439/411
6,261,119 B1 * 7/2001 Green ..... 439/411

FOREIGN PATENT DOCUMENTS

FR 2660490 A1 * 3/1990
GB 2219442 A1 * 6/1989
GB 2 266 628 3/1993
GB 2 299 901 10/1996

OTHER PUBLICATIONS

Copy of International Preliminary Examination Report.

* cited by examiner

ELECTRICAL CONNECTOR WITH DEFORMABLE INSERT

FIELD OF THE INVENTION

This invention relates to improvements in electrical connectors, in particular connectors for the mechanical connection or termination of one or more electrical conductors.

BACKGROUND OF THE INVENTION

Electrical connectors comprising a tubular socket into which the end of an electrical conductor is inserted are widely used. Clamping bolts are commonly held in threaded bores in the wall of the socket and are used to fix the conductor to the internal surface of the socket, thereby establishing electrical and mechanical connection between the conductor and the connector.

A disadvantage of connectors of this type is that the internal dimensions of the socket (normally the diameter in the case of a socket of circular bore) are fixed. If the conductor inserted into the socket has a diameter substantially less than the internal diameter of the socket then the assembly of socket and conductor will be asymmetrical. This creates increased electrical stress when voltage is applied and can lead to difficulty in achieving effective insulation around the assembly.

It is known to utilise socket inserts or shims to make the effective internal dimensions of the socket more suitable for conductors of reduced diameter. However, known forms of socket insert suffer from the disadvantage that they may be difficult to position correctly, may be dislodged and lost prior to use, and/or may interfere with the clamping action of the bolts.

SUMMARY OF THE INVENTION

There has now been devised an improved form of electrical connector which overcomes or substantially mitigates the above mentioned disadvantages.

According to the invention, an electrical connector comprises a connector body with a tubular socket to receive, in use, an electrical conductor, clamping means arranged to secure the electrical conductor within the socket, and a socket insert fitting within the socket so as to reduce the effective size of the socket, wherein the socket insert is tubular and is adapted to be deformed by the clamping means into retaining engagement with the electrical conductor.

The connector according to the invention is advantageous primarily in that the socket insert reduces the effective diameter of the socket and hence reduces the eccentricity of the positioning of a small diameter conductor within the socket. This in turn improves the electric field properties of the completed joint and makes it easier to insulate. Apart from the provision of the socket insert, the connector may be of conventional design, enabling the socket insert to be used with readily available connectors. The deformability of the socket insert enables secure retention of the conductor within the connector. The socket insert is also relatively easy to manufacture and use.

The deformability of the socket insert requires that it be manufactured of a suitably deformable material. A preferred material is aluminium, especially 99.9% pure aluminium. The socket insert is conveniently formed by an extrusion process.

The deformability of the socket insert may be further enhanced if it is formed with a castellated or corrugated profile. A socket insert of such a form represents a further aspect of the invention, which thus provides a socket insert for an electrical connector having a socket in which, in use, an electrical conductor is received, the socket insert being tubular and deformable, and having a castellated or corrugated profile. In a further aspect, the invention provides an electrical connector including such a socket insert.

By a "corrugated" profile is meant a profile in which the material of the socket insert is of substantially uniform thickness but is formed into a succession of peaks and troughs. The peaks and troughs may have any suitable form, eg a saw-tooth type form or a wave-like form.

The term "castellated" means an arrangement in which the thickness of the wall of the insert is non-uniform, the wall of the socket being formed with a series of longitudinal ridges spaced, preferably equally spaced, around the socket insert. The regions between the ridges constitute regions of reduced thickness. The precise profile of the ridges and the intervening regions may have any suitable form.

A castellated profile is particularly preferred, as the ridges support the side of the socket insert remote from the clamping means when the socket insert is engaged by the clamping means, and this gives rise to more controlled deformation of the socket insert and hence more secure and efficient electrical connection between the conductor and the connector body.

The internal surface of the tubular socket insert may be provided with serrations or tooth-like formations to improve the grip of the socket insert on the electrical conductor and/or to improve the manner in which the socket insert is deformed in use.

The socket is most preferably a bore, most commonly a blind bore, of circular cross-section.

The clamping means preferably comprises one or more clamping bolts held in threaded bores in the connector body such that they extend into the socket so as to clamp, via the socket insert, a connector inserted therein against the opposing surface of the socket. The bolts may have shearable heads which shear off when the applied torque exceeds a predetermined value.

BRIEF DESCRIPTION OF THE DRAWINGS

The invention will now be described in greater detail, by way of illustration only, with reference to the accompanying drawings, in which.

DETAILED DESCRIPTION OF THE ILLUSTRATED EMBODIMENTS

Figure 1:
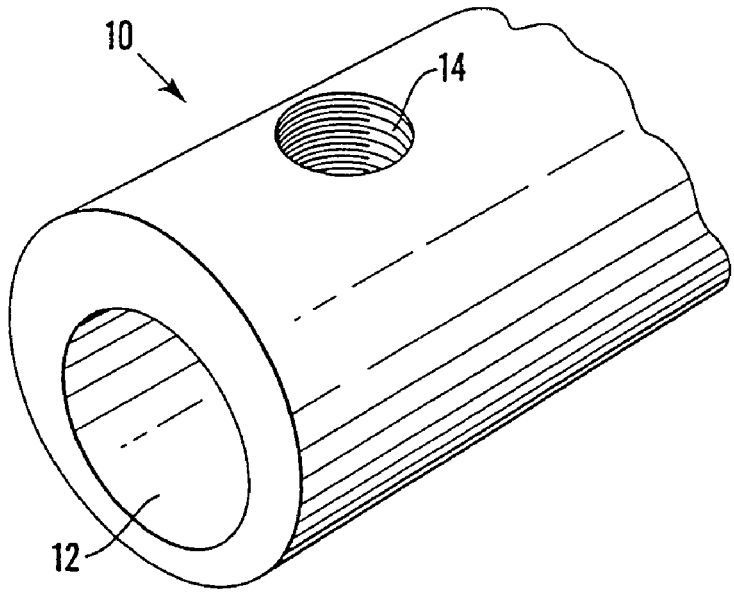
FIG. 1 is a perspective view of the end of a connector body forming part of an electrical connector according to the invention.

Referring first to FIG. 1, a connector body 10 is formed from aluminium and comprises a tubular socket 12. The portion of the body 10 shown may be formed integrally with one or more similar parts incorporating further similar sockets, eg for end-to-end connection of two conductors. Alternatively, the body 10 may be formed integrally with a fixing flange for termination of the conductor.

Figure 3:
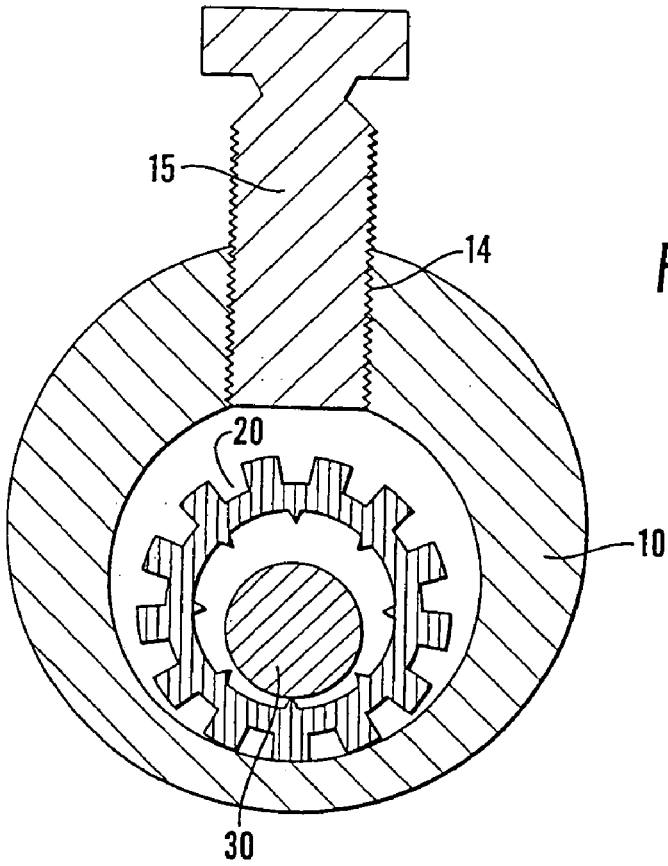
FIG. 3 is a cross-sectional view of an assembled connector comprising the connector body of FIG. 1 and the socket insert of FIG. 2, with an electrical conductor inserted into the socket insert but prior to securing of the conductor.
Figure 4:
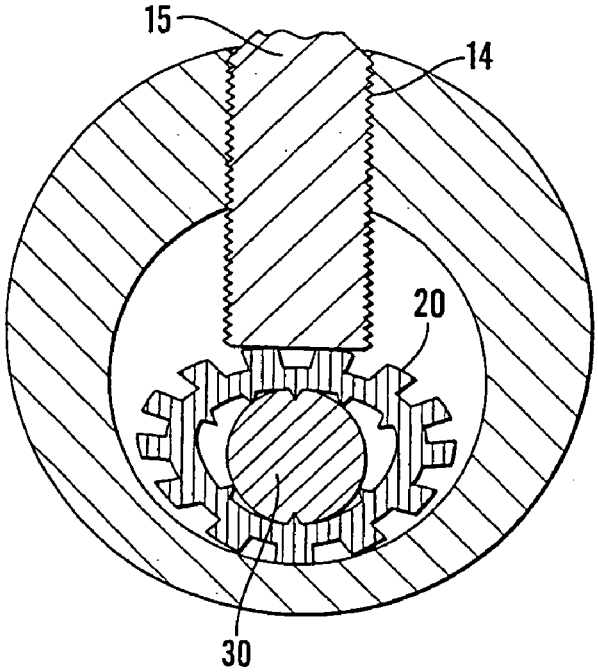
FIG. 4 is a view similar to FIG. 3, but after securing of the conductor within the connector.

A wall of the body 10 has a threaded bore 14 to receive a shear-head clamping bolt 15 (see FIGS. 3 and 4). The body 10 may be provided with more than one, eg two, such threaded bores 14.

Figure 2:
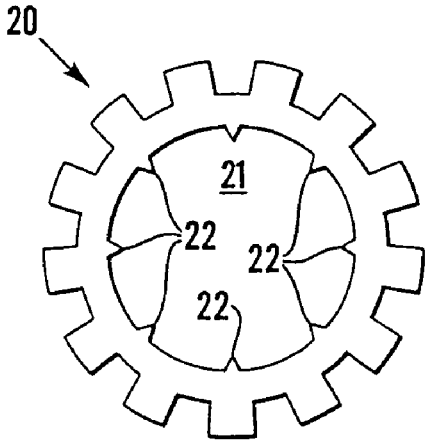
FIG. 2 is an end view of a first embodiment of a socket insert for use with the connector body of FIG. 1.

A large diameter conductor may be inserted directly into the socket 12 and clamped using a bolt 15. For use with smaller diameter conductors, however, the socket insert 20 shown in FIG. 2 is used. The insert 20 has the form of an extruded aluminium tube with a castellated profile. The internal bore 21 of the insert 20 is formed with a number of axial teeth 22 which enhance the engagement of the insert 20 with a conductor inserted into the bore 21.

The connector may be supplied with the insert 20 in position, in which case a simple resilient C-clip or the like (not shown), eg of plastics material, may be fitted into the open end of the socket 12 to prevent the insert 20 being dislodged prior to use.

In use, if a relatively large diameter conductor is to be clamped in the socket 12, the insert 20 is removed from the socket 12 and the conductor inserted. The clamping bolt(s) 15 are tightened until they clamp the conductor against the internal surface of the socket 12.

For a smaller diameter conductor 30 (see FIGS. 3 and 4), the insert 20 remains in position. The conductor 30 is inserted into the internal bore of the insert 20. The clamping bolt(s) 15 are then tightened until their tips engage and deform the insert 20. Continued tightening of the bolt(s) 15 securely clamps the conductor 30 within the socket 12, the head of each clamping bolt 15 shearing off when a predetermined torque is applied (as shown in FIG. 4). The effect of the insert 20 is to displace the longitudinal axis of the conductor 30 closer to the centre line of the connector body 10 than would be the case if no insert were used. This improves the electric field properties of the completed connection and makes it easier to insulate. In addition, the same length of clamping bolt 15 can be used as for a larger diameter conductor.

Figure 5:
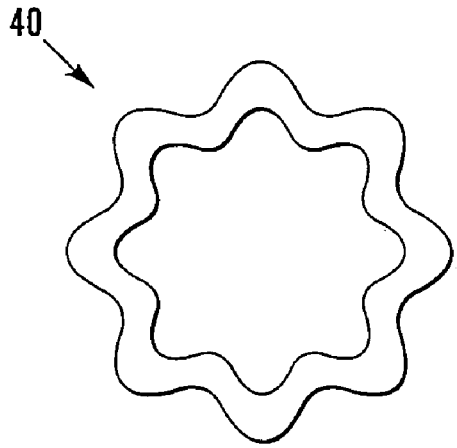
FIG. 5 is a cross-sectional view of a second embodiment of a socket insert.

The socket insert 40 shown in FIG. 5 differs from that of FIG. 2 in that it is of corrugated, rather than castellated, form.

The foregoing is illustrative of the present invention and is not to be construed as limiting thereof. Although a few exemplary embodiments of this invention have been described, those skilled in the art will readily appreciate that many modifications are possible in the exemplary embodiments without materially departing from the novel teachings and advantages of this invention. Accordingly, all such modifications are intended to be included within the scope of this invention as defined in the claims. In the claims, means-plus-function clauses are intended to cover the structures described herein as performing the recited function and not only structural equivalents but also equivalent structures. Therefore, it is to be understood that the foregoing is illustrative of the present invention and is not to be construed as limited to the specific embodiments disclosed, and that modifications to the disclosed embodiments, as well as other embodiments, are intended to be included within the scope of the appended claims. The invention is defined by the following claims, with equivalents of the claims to be included therein.

What is claimed is:

1. An electrical connector comprising a connector body including a tubular socket configured to receive an electrical conductor, clamping means arranged to secure the electrical conductor within the socket, and a preformed tubular socket insert fitting within the tubular socket so as to reduce the effective size of the socket, wherein the socket insert is adapted to be deformed by the clamping means into retaining engagement with the electrical conductor and wherein the clamping means comprises at least one clamping bolt held in at least one respective threaded bore in the connector body such that the at least one clamping bolt extends into the socket so as to clamp, via the socket insert, an electrical conductor inserted in the socket against an opposing surface of the socket.

2. A connector as claimed in claim 1, wherein the socket insert is aluminum.

3. A connector as claimed in claim 1, wherein an internal surface of the tubular socket insert has at least one of serrations or tooth-like formations.

4. A connector as claimed in claim 1, wherein the socket is a bore of substantially circular cross-section.

5. A connector as claimed in claim 1, wherein the at least one clamping bolt includes a shearable head that shears off when a torque applied to the at shearable head exceeds a predetermined value.

6. The electrical connector of claim 1 wherein the preformed tubular socket insert comprises an extruded tubular structure.

7. The electrical connector of claim 1 wherein the preformed tubular socket insert comprises a circumferentially continuous tubular structure with no overlying layers.

8. The electrical connector of claim 1 wherein the socket insert is configured to reduce eccentricity of positioning of the electrical conductor within the socket.

9. A connector as claimed in claim 1, wherein the socket insert has at least one of a castellated or corrugated profile on an outside surface thereof.

10. A connector as claimed in claim 9, wherein the socket has a castellated profile.

11. A socket insert for an electrical connector having a socket in which, in use, an electrical conductor is received, the socket insert comprising a preformed tubular and deformable member having at least one of a castellated or corrugated profile on an outside surface thereof.

12. A socket insert as claimed in claim 11 wherein the socket insert comprises aluminum.

13. A socket insert as claimed in claim 11 wherein the socket insert has a castellated profile on an outside surface thereof.

14. A socket insert as claimed in claim 11, wherein an internal surface of the tubular socket insert includes at least one of serrations or tooth-like formations.

15. An electrical connector comprising:

a connector body defining a socket therein;

a clamping member coupled to the connector body adapted to secure an electrical conductor within the socket; and a preformed tubular socket insert positioned within the socket adjacent the clamping member, the socket insert being configured to be deformed by the clamping member into retaining engagement with the electrical conductor within the socket.

16. The electrical connector of claim 15 wherein the socket insert has a castellated profile on an outside surface thereof.

17. The electrical connector of claim 15 wherein the socket insert has a corrugated profile on an outside surface thereof.

18. The electrical connector of claim 15 wherein the socket insert comprises aluminum.

19. The electrical connector of claim 15 wherein the clamping member comprises at least one bolt, the at least one bolt being positioned in a threaded bore in the connector body.

20. The electrical connector of claim 15 wherein the electrical conductor is received within the tubular socket insert to position the socket insert between the clamping member and the electrical connector and between an opposing surface of the socket relative to the clamping member and the electrical conductor.

21. The electrical connector of claim 20 wherein an internal surface of the socket insert includes at least one of serrations or tooth-like formations.

22. The electrical connector of claim 15 wherein the socket insert is movably positioned in the socket when not contacted by the clamping member.

23. The electrical connector of claim 22 wherein the socket insert has a diameter selected to reduce an effective diameter of the socket to reduce eccentricity of positioning of the electrical conductor within the socket.

24. An electrical connector comprising:

a connector body defining a socket therein;

a clamping member coupled to the connector body adapted to secure an electrical conductor within the socket;

a substantially tubular preformed socket insert positioned within the socket adjacent the clamping member, the socket insert being configured to be deformed by the clamping member into retaining engagement with the electrical conductor within the socket; and wherein the electrical conductor is received within the tubular socket insert to position the socket insert between the clamping member and the electrical connector and between an opposing surface of the socket relative to the clamping member and the electrical conductor.

25. The electrical connector of claim 24 wherein the socket insert has at least one of a castellated or corrugated profile on an outer surface thereof.

26. The electrical connector of claim 24 wherein the socket insert is movably positioned in the socket when not contacted by the clamping member.

27. The electrical connector of claim 26 wherein the socket insert has a diameter selected to reduce an effective diameter of the socket to reduce eccentricity of positioning of the electrical conductor within the socket.

28. The electrical connector of claim 26 wherein the socket insert has a diameter less than a diameter of the socket to allow the socket insert to be movably positioned in the socket when not contacted by the clamping member.

* * * * *